United States Patent [19]

Eckert et al.

[11] 4,096,999

[45] Jun. 27, 1978

[54] FUEL INJECTION VALVE FOR PRELIMINARY AND PRINCIPAL INJECTION

[75] Inventors: Konrad Eckert, Stuttgart; Karl Hofmann, Neckarrems; Kurt Seifert, Esslingen, all of Germany

[73] Assignee: Robert Bosch GmbH, Stuttgart, Germany

[21] Appl. No.: 745,666

[22] Filed: Nov. 29, 1976

[30] Foreign Application Priority Data

Dec. 6, 1975 Germany ..... 2555019

[51] Int. Cl.[2] ..... B05B 1/30

[52] U.S. Cl. ..... 239/533.5

[58] Field of Search ..... 239/533.3, 533.12

[56] References Cited

U.S. PATENT DOCUMENTS

| | | | |
|---|---|---|---|
| 2,591,401 | 4/1952 | Camner | 239/533.3 X |
| 3,669,360 | 6/1972 | Knight | 239/533.8 X |
| 3,718,283 | 2/1973 | Fenne | 239/533 A |

*Primary Examiner*—John J. Love

*Attorney, Agent, or Firm*—Edwin E. Greigg

[57] ABSTRACT

A fuel injection valve assembly for supplying a preliminary injection of fuel of a constant amount regardless of engine speed before the main injection of fuel begins comprising a spring biased, fuel supply pressure responsive, preliminary injection piston for the preliminary injection, a fuel supply pressure responsive loading piston for controlling the main injection fuel flow and a needle valve, both of the latter being biased oppositely by a common spring. Separate supply ducts for the preliminary and main fuel injections and the arrangement of the valve surfaces on the loading piston and needle valve enable the loading piston to be held closed and the needle valve to be opened by the pressure imposed on the preliminary injection piston and remain open long enough for the preliminary injection piston to travel its full stroke before closing and before the needle valve is opened for the main injection.

5 Claims, 4 Drawing Figures

FUEL INJECTION VALVE FOR PRELIMINARY AND PRINCIPAL INJECTION

BACKGROUND OF THE INVENTION

The present invention relates to a fuel injection valve for preliminary fuel injection and main fuel injection, the needle valve of which is opened under the pressure of the fed-in fuel acting upon a surface of the valve as well as on piston members which are arranged to cooperate therewith, such opening being accomplished counter to the force of a closing spring which is associated with the needle valve.

In known fuel injection valves of this type, two pressure chambers are provided, each of which has one surface subjected to fuel pressure acting in the direction of opening of the needle valve. The supply of fuel to the two pressure chambers is controlled by the needle valve during its displacements, so that, after the preliminary injection stroke, only one of the surfaces is effective in the direction of opening. Apart from the fact that such a control requires an exceedingly precise manufacture of the controlling elements, the temporarily inoperative pressure chamber closed by the needle valve should have an additional relief valve for proper functioning. A further disadvantage of this known fuel injection valve consists in the fact that such an intervention in the fluid flow causes turbulence and changes in the direction of flow which may lead to pressure pulses which can influence the manner of injection, especially so as to introduce a dependence on the rotational speed.

OBJECTS AND SUMMARY OF THE INVENTION

Accordingly, it is the primary purpose of this invention to develop a fuel injection valve of the initially mentioned type in which no such pressure shocks are created in the flow of liquid and which, moreover, can be produced at a much smaller expense than the known fuel injection valve of this type.

It is a further object of this invention to provide piston members which after accomplishing a preliminary injection stroke are brought to bear against a stop which is fixed in the housing, so that only the needle valve will be effective for an additional opening stroke. Thus, the flow of liquid which is under pressure is not influenced in its basic direction of flow and no control points are provided which require a corresponding precision for the separation of the hydraulic flow.

The invention will be better understood as well as other objects and advantages thereof become more apparent from the following detailed description of the invention taken in conjunction with the drawing.

DESCRIPTION OF THE PREFERRED EMBODIMENTS

Figure 1:
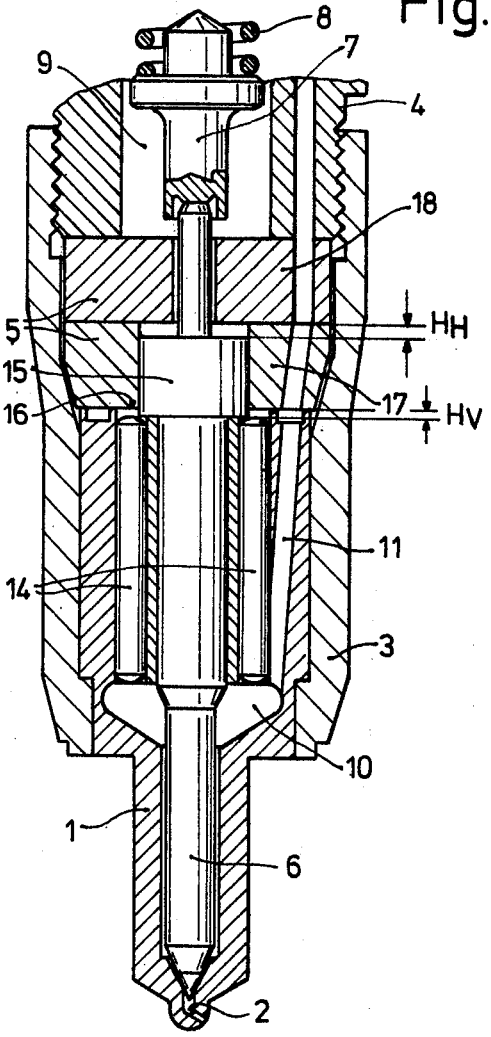
FIG. 1 is a cross-sectional view of an injection nozzle provided with a plurality of equidistantly spaced piston members.

Turning now to the drawings, a nozzle body 1 with an injection aperture 2 has been clamped down by means of a coupling nut 3 on a nozzle holder 4. Between the nozzle holder 4 and the body of the nozzle 1, at least one washer 5 has been disposed. In the valve body 1, a needle valve 6 has been mounted shiftably which is loaded by a closing spring 8 with interposition of a spring plate 7. The closing spring is disposed in an annular space 9 provided in the nozzle holder 4.

Between the nozzle body 1 and the needle valve 6, a pressure chamber 10 has been provided. The fuel fed in under pressure by a fuel injection pump (not shown) is supplied to this pressure chamber 10 via a line 11, so that where sufficient pressure exists, the needle valve 6 is shifted and the fuel is injected into the combustion chamber of the engine via the injection aperture 2.

In the case of the first embodiment shown in FIG. 1, two or more pistons 14 are disposed in the body of the nozzle 1 in parallel to the needle valve 6, which pistons are guided in the body of the nozzle 1 axially shiftably and sealingly. The lower extremity of these pistons 14 is acted upon by the fuel pressure in the pressure chamber 10 and their upper ends are arranged in contact with a head 15 which is integral with the needle valve 6. After accomplishing one of the preliminary injection strokes of the needle valve 6 as indicated at $H_V$ during which time the parallel pistons 14 also move upwardly, said pistons 14 abut against the surface 16 which is provided by the disc 17. It will be noted that the head 15 is guided in an axial bore in disc 17. After the pistons 14 are brought to bear against the stop 16, only the needle valve 6 will continue to move upwardly in the direction of opening, so that after increase of the pressure of the supplied fuel the needle valve continues its opening stroke for the main injection. Thus, after being advanced for the main injection to the point indicated by $H_H$, the head 15 of the needle valve 6 is brought to bear against an intermediate plate 18 by means of which the maximum opening stroke of the needle valve 6 is determined. The area into which the pistons 14 and the head 15 move during the opening stroke are connected with the spring chamber 9 in an unthrottled manner.

Figure 2:
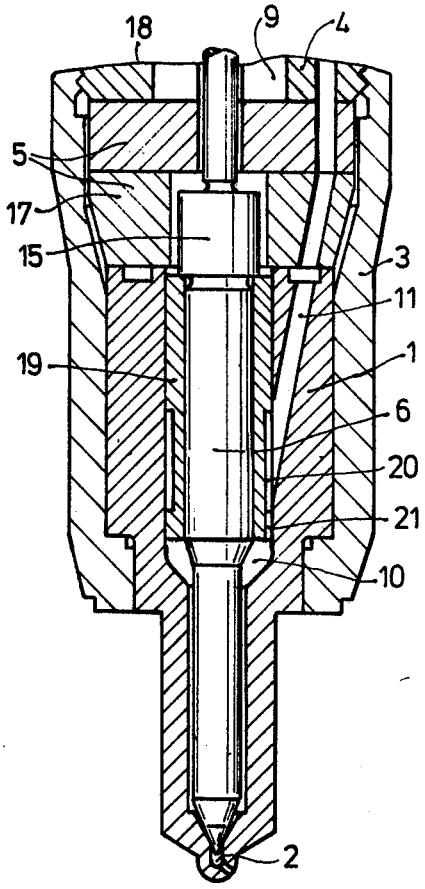
FIG. 2 is a cross-sectional view of a further embodiment of the invention showing a sleeve surrounding the needle valve.

In the case of the embodiment shown in FIG. 2, an annular sleeve 19 encompasses the needle valve 6 in lieu of two or more pistons as depicted in FIG. 1, said annular sleeve being arranged to be sealed relative to the inner wall of the nozzle body 1 as well as the exterior wall of the needle valve 6 and adapted for axial movement therebetween. Said sleeve 19 extends up to the pressure chamber 10 provided in the body 1 of the nozzle, and the annular groove 20 communicates with the pressure line 11 which in turn is connected with the pressure chamber 10 via longitudinal grooves 21. Thus, as explained in connection with the embodiment shown in FIG. 1, this annular sleeve which functions as a piston, strikes against the surface 16 of disc 17 after completing the preliminary injection stroke, as a result of which it then serves no further function as a means acting in the opening direction and the main injection continues.

Figure 3:
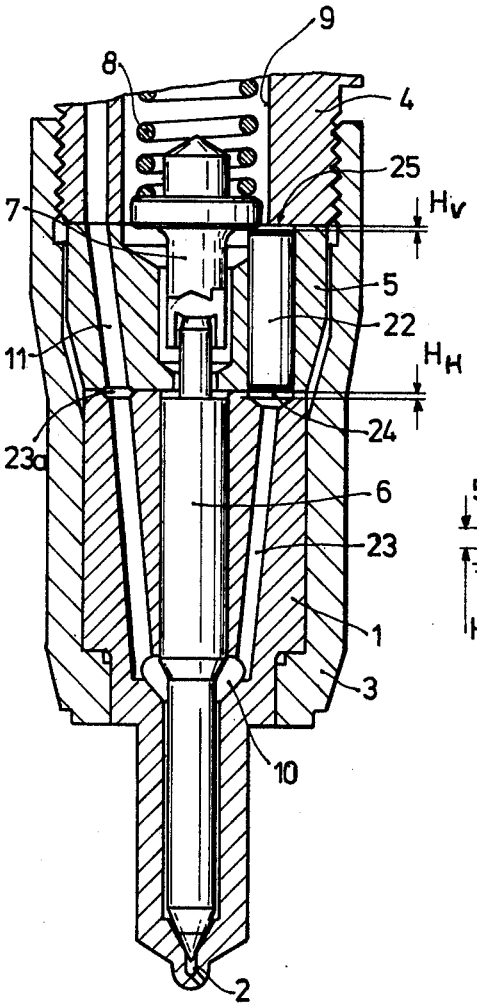
FIG. 3 shows a still further embodiment of the invention.

The third embodiment of the invention according to FIG. 3 shows an arrangement wherein one of two or more auxiliary pistons 22, which are disposed in apertures in the intermediate plate 5 are arranged to act directly on the spring seat disc 7. The fuel pressure is transmitted from the pressure chamber 10 to the lower frontal side 24 of this auxiliary piston 22, via a pressure line 23. The bore 23 may be omitted whenever the front side 24 is connected by an annular groove **23*a* with the pressure line 11. After the preliminary injection stroke movement depicted at $H_V$, the auxiliary piston 22 is brought into contact with the lower surface of the nozzle holder 4 at 25. Thereafter, as explained in connection with FIG. 1, the needle valve 6** will continue to move upwardly for the further main injection stroke as shown at $H_H$.

Figure 4:
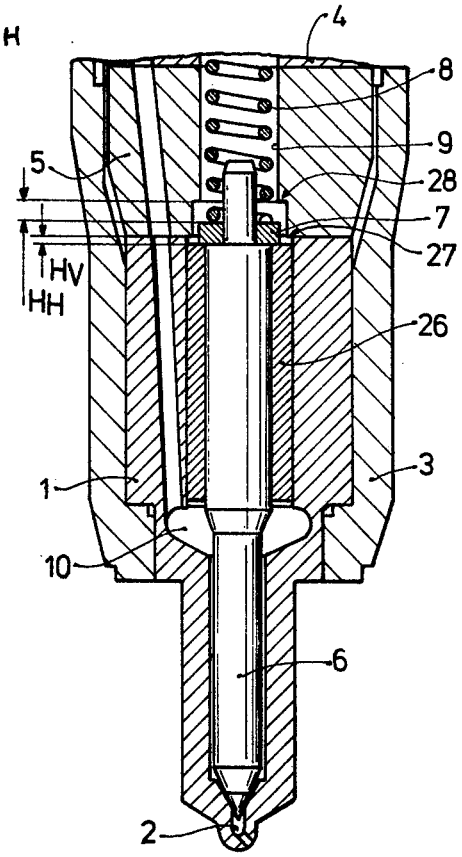
FIG. 4 shows yet another embodiment of the invention.

In the fourth embodiment of the invention as shown in FIG. 4, the auxiliary piston also comprises a slidable sleeve 26 which is generally similar to the embodiment shown in FIG. 2. In this embodiment also, as was explained earlier, the intermediate disc 5 (FIG. 3) will, after completion of the preliminary injection stroke, function to stop upward movement of the sleeve 26 as indicated at 27. The undercut shoulder 28 also provided on disc 5 serves as a means to limit the stroke for the main injection movement of the sleeve 26 as indicated and against which the spring seat disc 7 is brought to bear after completion of the main injection stroke.

What is claimed is:

1. In a fuel injection valve for injecting a preliminary and main fuel quantity under pressure, including:

a nozzle body defining a valve seat, an injection aperture, at least part of a pressure chamber and at least part of a fuel line through which fuel is delivered to the pressure chamber, said aperture, pressure chamber and fuel line being in communication for the passage of fuel from the injection valve; a closing spring; and a needle valve in communication with the pressure chamber, and displaceable by the force of the closing spring against the fuel pressure into engagement with the valve seat the thereby terminate fuel flow from the injection aperture, the improvement comprising:

at least one piston means in communication with the pressure chamber, for joint displacement with the needle valve by the fuel pressure, in a direction opposite to the direction in which the needle valve displaced by the closing spring; and means defining a stop surface which is engageable with said at least one piston means, said stop surface defining means, being located in the path of the displacement of said at least one piston means by the fuel pressure such that the displacement of said at least one piston means by the fuel pressure is terminated prior to the termination of the displacement of the needle valve by the fuel pressure, said joint displacement of the needle valve and said at least one piston means, being associated with the injection of the preliminary fuel quantity, and said displacement of the needle valve after termination of the displacement of said at least one piston means being associated with the injection of the main fuel quantity.

2. A fuel injection nozzle as claimed in claim 1, wherein the needle valve has an enlarged shaft area which includes a headed portion having a surface area which functions as said stop for said piston means.

3. A fuel injection nozzle as claimed in claim 1, wherein the needle valve has an enlarged shaft area, and wherein the piston means are spaced equidistantly about said enlarged shaft area.

4. A fuel injection nozzle as claimed in claim 1, in which the piston means comprise a reciprocable sleeve.

5. A fuel injection nozzle as claimed in claim 4, in which the reciprocable sleeve includes an annular channel.

* * * * *